United States Patent [19]

Vickers

[11] 4,250,237

[45] Feb. 10, 1981

[54] P-TERPHENYL ORGANIC PHOTOCONDUCTORS AND HETEROGENEOUS COMPOSITIONS THEREOF

[75] Inventor: Richard S. Vickers, Rochester, N.Y.

[73] Assignee: Eastman Kodak Company, Rochester, N.Y.

[21] Appl. No.: 800,601

[22] Filed: May 25, 1977

[51] Int. Cl.[3] ..... G03G 5/04

[52] U.S. Cl. ..... 430/17; 430/70; 430/83; 430/135; 585/25

[58] Field of Search ..... 96/1.5, 1 PC; 252/267, 252/364; 260/668 R, 668 A, 668 F; 430/17, 70, 83, 135; 585/25

[56] References Cited

U.S. PATENT DOCUMENTS

| | | | |
|---|---|---|---|
| 2,363,209 | 11/1944 | Swisher | 260/267 |
| 3,287,123 | 11/1966 | Hoegl | 260/267 |
| 3,948,789 | 4/1976 | Brooks | 252/65 |
| 4,145,214 | 3/1979 | Yoerger | 96/1 PC |

FOREIGN PATENT DOCUMENTS

| | | | |
|---|---|---|---|
| 1258844 | 3/1961 | France | 96/1.5 |

OTHER PUBLICATIONS

C. A. 86:155116s–Synthesis and Liquid Crystal Prop., Gray et al., 1976.

C. A. 81:49409b–Isolation of p-terphenyl from Technical Mixtures of terphenyls, Orechkin et al., (4–30–74).

C. A. 76:133700u–Population of Transfer States, Furst et al., 1971.

Tess–Solvents Theory and Practice, (Sep. 1971), pp. 48–55, Solvent Selection (Hansen).

Barton–Solubility Parameters, Chemical Reviews, 1975, vol. 75, #6, pp. 731–753.

*Primary Examiner*—J. Travis Brown

*Attorney, Agent, or Firm*—J. L. Tucker

[57] ABSTRACT

High speed organic photoconductors are produced by crystallizing p-terphenyl from solution in a solvent having defined solubility parameter limits. Heterogeneous photoconductive insulating compositions comprising a dispersion of these p-terphenyls in an electrically insulating binder can be applied to an electrically conducting support to provide an electrophotographic element with high photoconductive speed.

15 Claims, No Drawings

P-TERPHENYL ORGANIC PHOTOCONDUCTORS AND HETEROGENEOUS COMPOSITIONS THEREOF

BACKGROUND OF THE INVENTION

1. Field of the Invention

This invention relates to p-terphenyl photoconductors. More specifically, it relates to p-terphenyl photoconductors crystallized from solvents having certain solubility parameter limits. Such photoconductors can be employed in heterogeneous photoconductive insulating compositions.

2. Discussion of Related Art

The process of xerography, as disclosed by Carlson in U.S. Pat. No. 2,297,691 employs an electrophotographic element comprising a support material bearing a coating of a normally insulating material whose electrical resistance varies with the amount of incident electromagnetic radiation it receives. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material, or toner, whether contained in an insulating liquid or on a dry carrier, can be deposited on the exposed surface in accordance with either the charge pattern of discharge pattern as desired. Deposited marking material can then be either permanently fixed to the surface of the sensitive element by known means such as heat, pressure, solvent vapor, or the like, or transferred to a second element to which it can similarly be fixed. Likewise, the electrostatic latent image can be transferred to a second element and developed there.

Various photoconductive insulating materials have been employed in the manufacture of electrophotographic elements. For example, vapors of selenium and vapors of selenium alloys deposited on a suitable support, and particles of photoconductive zinc oxide dispersed in resinous, film-forming binder have found wide application in the present-day document copying applications.

Since the introduction of electrophotography, a great many organic compounds have also been screened for their photoconductive properties. As a result, a very large number of organic compounds have been shown to possess some degree of photoconductivity. Many organic compounds have revealed a useful level of photoconduction and have been incorporated into photoconductive compositions.

In photoconductive insulating compositions using organic photoconductors, the photoconductor, if not polymeric, is usually carried in a film-forming binder. Typical binders are polymeric materials having fairly high dielectric strength such as phenolic resins, ketone resins, acrylic ester resins, polystyrenes and the like. A more comprehensive listing of binders appears in U.S. Pat. No. 3,755,310. The photoconductor can be dissolved with the binder to prepare a homogeneous photoconductive composition in a common solvent. In another aspect, it can be provided as a dispersion of small particles in the binder to prepare a heterogeneous photoconductive composition. A general discussion of such dispersions and their preparation appears in U.S. Pat. No. 3,253,914.

Organic photoconductors demonstrate widely varying degrees of solubility in organic solvents used to dissolve many of the common binders. In the preparation of homogeneous photoconductive insulating compositions, organic photoconductors such as polyphenyls and others of low solubility in popular solvents cannot usually be included in sufficient concentration to provide compositions of desirable light-sensitivity. By use of dispersion techniques such as those referred to previously, heterogeneous photoconductive insulating compositions having higher concentrations of low solubility photoconductors can be obtained, the objective being to improve light-sensitivity in the composition.

Heterogeneous organic photoconductive compositions as discussed herein can be advantageous, especially in the preparation of electrophotographic elements on which visible images will be provided. For example, elements comprising such compositions are both lighter in weight than elements having inorganic photoconductive compositions comprising, for example, zinc oxide, and can be prepared to resemble bond paper.

P-terphenyl organic photoconductors are known to the art. See U.S. Pat. No. 3,287,123 issued Nov. 22, 1966 to Helmut Hoegl. They are particularly attractive in terms of cost, color, weight, stability and the like. However, as with other organic photoconductors employed in heterogeneous compositions, p-terphenyls have not enjoyed the popularity of photoconductive insulating compositions using inorganic photoconductors. This is due largely to the low photoconductivity of p-terphenyl. To improve the performance of p-terphenyl, one may employ sensitizing agents to increase the p-terphenyl photoconductivity, and/or it may be desirable to co-crystallize p-terphenyl with one of its chemical cousins such as p-quaterphenyl, p-pentaphenyl, p-sexiphenyl etc. See copending U.S. Patent Application Ser. No. 800,509 entitled CO-CRYSTALLINE ORGANIC PHOTOCONDUCTORS AND HETEROGENEOUS COMPOSITIONS THEREOF filed concurrently herewith now U.S. Pat. No. 4,145,214, issued Mar. 20, 1979, in the name of William E. Yoerger, describing co-crystalline p-terphenyl and p-quaterphenyl. In accordance with the invention described herein, an alternative method is described for providing p-terphenyl of high photoconductivity.

SUMMARY OF THE INVENTION

In accordance with the invention, p-terphenyl photoconductors having high electrophotographic speed are produced by forming a solution of p-terphenyl in a solvent having certain solubility parameters, and crystallizing the p-terphenyl from the solution. P-terphenyl produced in this manner exhibits greater photoconductivity than p-terphenyl produced by crystallization from solution in solvents having values for such parameters outside the range given below. The crystallized p-terphenyl can be employed as fine particles dispersed in electrically insulating binders to produce high speed heterogeneous photoconductive compositions. Crystallization according to the invention is carried out using a solvent having solubility parameters in about the following ranges:

$\delta_d$ (dispersion component): 7.1–8.3
$\delta_p$ (polar component): 1.4–5.1
$\delta_h$ (hydrogen bonding component): 2.8–8
The determination of solubility parameters for a given solvent is described in greater detail below:

Preferred solvents having solubility parameters within the above ranges are acetic acid, acetone, butyl acetate, ethyl acetate, 2-propanol, or a mixture of acetic acid and xylene in which there is at least 25 volume percent of acetic acid.

In a presently preferred embodiment of the invention, p-terphenyl crystallized from the above solvent is employed in a heterogeneous photoconductive insulating composition. When this composition is coated on an electrically conducting support, such as conductive paper, an electrophotographic element is produced having physical attributes closely resembling ordinary bond paper.

DETAILED DESCRIPTION OF THE INVENTION

Recent developments have advanced the photoconductive quality of heterogeneous photoconductive compositions composed of organic photoconductor dispersions which are useful in such applications as photoconductor-coated paper materials. Such heterogeneous compositions now exhibit photoconductive properties comparable to inorganic photoconductor compositions such as ones comprising zinc oxide particles. The present invention contributes to the overall gains of organic photoconductors by providing high speed p-terphenyl through crystallization from particular solvents. It has now been found that solvents including liquids such as acetone, acetic acid, and mixtures of two or more liquids such as xylene and acetic acid, impart high photoconductivity to p-terphenyl when the latter is crystallized therefrom. Of numerous solvents studied, those which produced highly photoconductive p-terphenyl by crystallization were found to possess solubility parameters in ranges which are common to such solvents. Solvents having solubility parameters outside such common ranges, on the other hand, produced p-terphenyl having significantly lower photoconductivity by comparison. In accordance with the invention, therefore, solvents having solubility parameters within about the following ranges are employed to produce p-terphenyl that exhibits high photoconductivity:
$\delta_d$ (dispersion component): 7.1–8.3
$\delta_p$ (polar component): 1.4–5.1
$\delta_h$ (hydrogen bonding component): 2.8–8

The use of solubility parameters to implement solvent selection has gained notable acceptance in the art, as evidenced by the articles referenced below. Apparently molecules or structural units of solvents or solvent mixtures are cohesively united as quantified by a characteristic "cohesive energy density". In a simplistic sense, the cohesive energy density of solvents may represent the threshold energy which solutes must overcome in order to associate with solvent molecules or units and form a true solution. Cohesive energy-density, furthermore, has been shown to be composed of three determinable components, $\delta_d$, $\delta_p$, $\delta_h$, which represent respectively "dispersion" type atomic interactions, permanent dipole interactions or polar forces, and hydrogen bonding-type forces. By identifying or "fingerprinting" any given solvent by its solubility parameters, the ability of a solvent to dissolve a particular solute can be extrapolated to solvents having similar solubility parameters. After studying a representative number of solvents, and grouping those solvents which perform as described, one can define a "domain" of solvents for the desired solute, the limits of the domain being in turn established by the ranges in which the solubility parameters of the desired solvents fall.

While solubility parameters have been emloyed largely to predict the propensity of solvents and solutes to form solutions or similar stable systems, they have not been known to bear any relationship with the photoconductive properties acquired by p-terphenyl as a consequence of crystallization from certain solvents. According to the invention at hand, it has been found both that p-terphenyl photoconductivity is dependent on the solvent from which it is crystallized and that a domain of solubility parameters is related to the attainment of high p-terphenyl photoconductive speeds. The discovered domain is established by the above defined solubility parameter ranges.

Each of the solubility parameters indicated are determined at 25° C. in accordance with the methods of Charles Hansen and Alan Beerbower disclosed in *Encyclopedia of Chemical Technology,* Supplemental Volume pp. 889–910 (Interscience, N.Y., 1971). Specifically, the dispersion component, $\delta_d$, is determined from the energy of vaporization of the homomorph or hydrocarbon counterpart of the solvent under consideration. For this purpose a homomorph of a solvent is that saturated hydrocarbon that most nearly resembles the solvent in size and shape. In this regard, the homomorph must also have the same or essentially the same molar volume as the solvent. Homomorphs for typical solvents can be identified in Charles M. Hansen's article "Three Dimensional Solubility Parameter-Key to Paint Component Affinities:" published in *Journal of Paint Technology,* Volume 39, No. 505, February, 1967, pp, 104–117 and, in particular, Table 1 of that article. See also "Solubility Parameters" by Allan F. M. Barton, *Chemical Reviews,* 1975, Volume 75, No. 6, pp. 731–753, in particular, page 738.

The polar component is calculated form the modified equation of Böttcher:

$$\delta_p^2 = \frac{12{,}108}{V^2} \; \frac{\epsilon - 1}{2\epsilon - \eta_D^2} \cdot (\eta_D^2 + 2)\nu^2$$

Where V is the molar volume, $\epsilon$ is the dielectric constant (static value), $\eta_D$ is the index of refraction for D light (sodium), and $\nu$ is the dipole moment expressed in Debye units ($10^{-18}$(esu) (cm)).

The hydrogen bonding type component is determined from the relationship:

$$\delta_h = \left(\frac{\Delta E}{V}\right)^{\frac{1}{2}}$$

where V is the molar volume and $\Delta E$ is assigned a value of 4,650 calories for each functional group present in the solvent molecule.

Solubility parameter determinations outlined above are employed solely for single component solvent systems. In the case of multicomponent solvent systems (mixtures of two or more liquids), the parameters of the respective solvent components contribute to the overall parameters of the system according to the proportion of the respective solvent components in the system. Interestingly, when solvents having mixtures of two or more liquids are grouped according to their parameters, it is entirely possible and probable that components of the mixture can individually fall outside the domain of the p-terphenyl crystallization under consideration, while the mixture is within the domain. Picture, for example, the domain represented as a volume in a 3 dimensional coordinate system. Though the parameters of solvent components fall outside the volume, straight lines joining parameter points of any two components may pierce the volume so that a portion of such straight line falls within the desired domain. This has been demonstrated in the case at hand where p-terphenyl exhibiting high photoconductivity was produced by crystallization from a mixture of acetic acid and xylene in a volume ratio of 25/75. While acetic acid ($\delta_d=7.1$, $\delta_p=3.9$, $\delta_h=6.6$) falls within the defined domain, xylene ($\delta_d=8.65$, $\delta_p=0.5$, $\delta_h=1.5$) does not and in fact when used as the sole solvent, fails to produce p-terphenyl of high photoconductivity by crystallization (see example 13 hereinafter).

It must be emphasized that the domain defined in accordance with the invention does not represent necessarily a region in which p-terphenyl is most solute in the traditional sense. 1,2-Dichloroethane, for example, is demonstrably a good solvent for p-terphenyl. Nonetheless, dichloroethane as solubility parameters ($\delta=9.3$, $\delta_p=3.6$, $\delta_h=2.0$) falling outside the defined domain and does not produce p-terphenyl exhibiting high photoconductivity by crystallization (see example 6 hereinafter).

That crystallography plays a significant role in the performance of organic photoconductor particles is not new to the art of electrophotography. See, for example, French Pat. No. 1,258,844 issued Mar. 13, 1961 to Paul Marie Cassiers. Furthermore, as the French patent points out, solvent selection plays a role in affecting crystal size upon crystallization. The basis for solvent selection, however, is limited at best only to coefficient of evaporation, which serves no purpose in selecting solvents that will perform in accordance with this invention. Accordingly, the French patent places in one group solvents which fall both within and outside the domain defined herein: acetone, ethyl acetate, and methyl acetate have parameters within the defined domain but methylene chloride and chloroform are outside.

It should be further noted, that a very few anomalies may exist in the peripheral regions of the defined domain. Tetrahydrofuran ($\delta_d=8.2$, $\delta_p=2.8$, $\delta_h=3.9$), for example, while nominally within the domain, does not yield p-terphenyl of high photoconductivity (of numerous solvents studied, tetrahydrofuran was the only anomaly). This can be explained by reference again to the volume defined by the solubility parameter ranges of the invention. In that volume, imperfections or "dents" are expected such that a few solvents, like tetrahydrofuran, may escape the grasp of the domain in highly localized surface regions of the volume. Anomalies aside, the significance of defining a domain for improving the photoconductivity of p-terphenyl by crystallization lies in the highly multiplied likelihood of success for proper solvent selection, with no more than routine experimentation being required.

In a preferred embodiment of the invention, the solubility parameter of solvents are in about the following ranges:

$\delta_d$: 7.1–7.7
$\delta_p$: 1.8–5.1
$\delta_h$: 3.1–8 thereby establishing a specific domain in which preferred solvents like acetone, ethyl acetate, n-butyl acetate 2-propanol, and acetic acid serve to produce high speed p-terphenyl as defined.

Examples of solvents or solvent mixtures that have the requisite solubility parameters to produce high speed p-terphenyl by crystallization are listed in Table A below. The solubility parameter values for individual solvents were obtained from the Barton articles mentioned previously. The parameters for mixtures were determined by the method disclosed previously.

TABLE A

| Solvent | Volume Ratio of Components in Mixtures | $\delta_d$ | $\delta_p$ | $\delta_H$ |
|---|---|---|---|---|
| acetone | | 7.6 | 5.1 | 3.4 |
| ethyl acetate | | 7.7 | 2.6 | 3.5 |
| n-butyl acetate | | 7.7 | 1.8 | 3.1 |
| 2-propanol | | 7.7 | 3.0 | 8.0 |
| acetic acid | | 7.1 | 3.9 | 6.6 |
| butyraldehyde | | 7.2 | 2.6 | 3.4 |
| n-butylamine | | 7.9 | 2.2 | 3.9 |
| 2-butanol | | 7.7 | 2.8 | 7.1 |
| ethylene glycol monomethyl ether | | 7.9 | 4.5 | 8.0 |
| acetaldehyde | | 7.2 | 3.9 | 5.5 |
| acetic acid/xylene* | 25/75 | 8.3 | 1.4 | 2.8 |
| acetone/toluene | 90/10 | 7.7 | 4.7 | 3.2 |
| 2-propanol/1,4-dioxane | 75/25 | 8.1 | 2.5 | 6.9 |
| di-n-octylphthalate/tetrahydrofuran | 45/55 | 8.2 | 3.1 | 2.8 |

*Xylene, as employed herein, is considered generic to all three isomers of xylene, as all three have solubility parmeters, as parameters, herein, that are substantially the same.

As used herein, the term crystallization refers to the process of forming crystals of p-terphenyl from a solution of p-terphenyl in one of the select solvents defined herein. Typically one can dissolve p-terphenyl in hot solvent, heat to reflux for a preselected period of time, and subsequently permit the solution to slowly cool. On reaching room temperature, the crystallized p-terphenyl can be recovered by filtration, and thereafter air dried for 24 hours or more. It will be appreciated, of course, that what is suitable for a bench scale operation, may require modification to accomodate commercial scale production.

Having improved the photoconductivity of p-terphenyl by crystallization as defined, the resulting p-terphenyl can be, according to another embodiment of the invention, dispersed in an electrically insulating binder to form a heterogeneous photoconductive insulating composition. These compositions are highly desirable when coated on electrically conducting supports, particularly conducting paper supports, as described in greater detail hereinafter.

Sensitizers can be included in the present photoconductive insulating compositions. Useful sensitizers include spectral sensitizers, which are intended primarily to make the photoconductor light-sensitive to spectral regions not within the region of its inherent sensitivity; and chemical sensitizers that serve primarily to increase light-sensitivity of the photoconductor in the spectral region of its inherent sensitivity as well as in those regions to which it may have been spectrally-sensitized.

Representative chemical sensitizers include polymeric sensitizers having monovalent side groups of the chlorendate radical, such as polyvinylchlorendate and others described in greater detail in copending U.S. Patent Application Ser. No. 800,594 entitled POLYMERIC CHEMICAL SENSITIZERS FOR OR- GANIC PHOTOCONDUCTIVE COMPOSITIONS by John M. McCabe et al and filed concurrently herewith now U.S. Pat. No. 4,166,666, issued July 10, 1979; hexachlorocyclopentane chemical sensitizers in combination with cellulose nitrate as described in copending U.S. Patent Application Ser. No. 800,483 entitled HEXACHLOROCYCLOPENTENE CHEMICAL SENSITIZERS FOR HETEROGENEOUS ORGANIC PHOTOCONDUCTIVE COMPOSITIONS by William E. Yoerger and filed concurrently herewith now U.S. Pat. No. 4,082,550, issued Apr. 4, 1978; quinoxalines and halogenated quinoxalines like 2,3,6-trichloroquinoxaline and others in combination with cellulose nitrate disclosed in copending U.S. Patent Application Ser. No. 800,587 entitled $\pi$-DEFICIENT N-HETEROAROMATIC CHEMICAL SENSITIZERS FOR HETEROGENEOUS ORGANIC PHOTOCONDUCTIVE COMPOSITIONS by William E. Yoerger and filed concurrently herewith now U.S. Pat. No. 4,119,460, issued Oct. 10, 1978. Other chemical sensitizers include mineral acid; carboxylic acids such as maleic, di- and trichloroacetic acids, and salicylic acids; sulfonic acids and phosphoric acids; and electron acceptor compounds as disclosed by H. Hoegl in *J. Phys. Chem.*, 69, No. 3, pages 755–766 (March, 1965) and in U.S. Pat. No. 3,232,755.

Spectral sensitizers can be included in the present photoconductive insulating compositions, which are intended primarily to make the photoconductor light-sensitive to spectral regions not within the region of its inherent sensitivity. Spectral sensitizers can be chosen from a wide variety of materials such as pyrylium dye salts inclusive of thiapyrylium and selenapyrylium dye salts such as those described in U.S. Pat. No. 3,250,615 (issued May 10, 1966 to C. C. Natali et al); the benzopyrylium or benzothiapyrylium type sensitizers described in U.S. Pat. No. 3,554,745 (issued Jan. 12, 1971 to J. A. Van Allan); and defensive publication T-889,023 (published Aug. 31, 1971 to G. A. Reynolds et al); or the cyanine, merocyanine or azacyanine dyes described in U.S. Pat. No. 3,597,196 (issued Aug. 3, 1971 to C. J. Fox et al).

Preferred spectral sensitizers for use with the present photoconductive compositions include the benzothiapyrylium dye cation 4-(thiaflavylidylmethylene) flavylium and/or the cyanine dye cation 1,3-diethyl-2-{2-(2,3,4,5-tetraphenyl-3-pyrrolyl)vinyl}-1H-imidazo{4,5-b}quinoxalinium.

In compositions of the subject type, chemical sensitizers are usually included in an amount of about 0.1% to about 10% by weight of the photoconductor. Spectral sensitizers are usually present in the composition in an amount of about 0.001% to about 0.1% by weight of the photoconductor. Wider ranges can be useful. In the case of spectral sensitizers, however, unduly high concentrations can produce color that is apparent to the eye and undesirably change the appearance of compositions that are intended to provide a white background.

Useful binders employed in the heterogeneous photoconductive compositions of the invention comprise polymers having fairly high dielectric strength and which are good electrically insulating film-forming vehicles. Materials of this type comprise styrene-butadiene copolymers; silicone resins; poly(vinyl chloride); poly(vinylidene chloride); vinylidene chloride-acrylonitrile copolymers; poly(vinyl acetals) such as poly(vinyl butyral); polyacrylic and polymethacrylic esters such as poly(methylmethacrylate), poly(n-butylmethacrylate), poly(isobutyl methacrylate), etc.; polystyrene; nitrated polystyrene; polymethylstyrene; isobutylene polymers, polyesters, such as poly(ethylenealkaryloxyalkylene terephthalate); phenol-formaldehyde resins; ketone resins; polyamides; polycarbonates; etc.

A preferred binder is cellulose nitrate. The choice of cellulose nitrate binder is variable, and cellulose nitrates having a nitrogen content of up to about 13 weight percent as shown by elemental analysis are preferred. Cellulose nitrate having a nitrogen content from about 11.5 to about 13 percent is especially preferred. A wide range of cellulose nitrates, at different viscosities and different nitrogen contents, is available. Many such materials are discussed in *Nitrocellulose, Properties and Uses,* Hercules Powder Co., (1955). The cellulose nitrate binder should be soluble in a solvent or solvent mixture that has little or no solvent action on the organic photoconductor. Alcohol soluble cellulose nitrate is preferred, such as that which exhibits appropriate solubility in lower alcohols like methanol.

Most preferred binders employed in the practice of the invention comprise acrylic polymers such as polyacrylates; polymethacrylates; polyalkylmethacrylates including polymethyl- and polyethylmethacrylates, and the like; polyalkylacrylates including polymethyl- and polyethylacrylates, and the like; polyacrylic acid; polymethacrylic acid; poly alkylacrylic acids; and polyalkylmethacrylic acids. Acrylic binders are advantageous by virtue of their availability and resistance to abrasion (hardness). In addition, homopolymers comprising any of the above noted acrylic polymers, and copolymers of these acrylics with either an acrylic polymer or another type polymer can be employed. Especially preferred polymers are copolymers of an acrylate with either acrylic or alkylacrylic acid, such as a copolymer of methylmethacrylate with either methacrylic acid or acrylic acid.

Matting agents are usefully included in the present photoconductive insulating compositions. A matting agent tends to avoid glossiness that might otherwise be obtained in layers prepared using the subject compositions and thereby enhances the "plain paper" appearance and feel that can characterize electrophotographic elements of this invention that use a paper support. Further, matting agents can improve the capability of such layers to receive legibly information written or otherwise marked on the layer. Matting agents are preferably electrically inert and hydrophobic so as not to interfere with chargeability, charge retention or other parameters affecting electrophotographic imaging. Methacrylate and polyethylene beads are described in U.S. Pat. No. 3,810,759 (issued May 14, 1974 to T. H. Morse et al) as matting agents. Silicon containing materials are described as matting agents in U.S. Pat. No. 3,652,271 (issued Mar. 28, 1972 to D. M. Bornarth). An especially preferred silicon based matting agent is an inorganic oxide pigment, such as fumed silicon dioxide, that has been chemically modified to render it hydrophobic by reaction with an organic compound like a silane to substitute hydrocarbylsilyl or other hydrophobic groups for the hydroxyl groups originally on the silicon dioxide chain. The fumed silica or other inorganic oxide pigment can be reacted conveniently with an appropriate silane, such as a halotrialkylsilane, merely by contact in solution. A preferred silane is chlorotrimethylsilane and incorporation of the silane in an amount of about 5 to about 15% by weight of the inorganic pigment is especially desirable. It is considered that other inorganic pigments like titanium dioxide and aluminum oxide, as well as clays, could be modified similarly be reaction with a silane to provide useful matting agents. Matting agents can be employed in a wide range of particle sizes and concentrations to provide the desired degree of surface texture. It is also well known in the art to consider the thickness of the layer comprising the matting agent when selecting matting agent of a given particle size. See, for example, the aforementioned U.S. Pat. No. 3,652,271 and U.S. Pat. No. 3,519,819 issued July 7, 1970 to E. P. Gramza et al. It should be emphasized that such matting agents can be used to advantage in a wide range of homogeneous and heterogeneous photoconductive insulating compositions.

Photoconductive compositions of the invention can be prepared with the photoconducting compounds of the invention in the usual manner, i.e., by blending a dispersion of p-terphenyl together with a binder.

Heterogeneous photoconductive insulating compositions of the present invention can be prepared merely by dispersing the p-terphenyl photoconductor having the desired particle dimensions in a solution that contains the binder, and also any other constituents, e.g., spectral sensitizers, matting agents, etc., to be included in the composition. The binder's solvent should not have solvent action with respect to the photoconductor, neither should the photoconductor dissolve or swell in the presence of the binder solvent. After addition of the particulate p-terphenyl, the heterogeneous composition is usually stirred or otherwise mixed thoroughly to assure reasonable uniformity of the dispersion. The p-terphenyl desirably has a maximum particle diameter ranging from about 0.1 micron to about 20 microns and from about 0.1 micron to about 10 microns being preferred. If the photoconductor has not been ball-milled or otherwise processed to an appropriate particle size prior to its dispersion in the binder, a heterogeneous composition of the invention can be prepared and thereafter agitated in the presence of stainless steel balls or other agent effective to produce a milling action that causes attrition in the particle size of the photoconductor.

In the alternative, the photoconductor can be dispersed in a non-solvent that is a solvent for the binder, and ball-milled to provide photoconductor particles for use in the present photoconductive insulating compositions. Sensitizers to be included in the composition can be added to the photoconductor dispersion prior to such ball-milling. After this first ball-milling stage, the binder can be added. The composition is preferably again milled to obtain a uniform dispersion.

In the present heterogeneous compositions, the p-terphenyl is desirably included in an amount of at least about 40% by weight of solids in the composition and may range to 95 weight percent and higher depending on the particular application. Generally, the binder need only be present in an amount sufficient to provide adhesion between particles in the composition and between the composition and the support, if used. In various preferred embodiments, the photoconductor and any sensitizers, matte agents or other adjuvants constitute between about 70 and 90%, by weight, of solids in the composition, with the binder or binders making up the remainder of the composition.

As indicated above, the photoconductive insulating composition is usually prepared as a solution of the binder containing other components of the composition including dispersed p-terphenyl particles. In such form, the composition can be formed into a self-supporting member of it can be coated on an electrically conducting support to provide an electrophotographic element. For purposes of coating, the compositions desirably range from about 20 weight percent solids to about 40 weight percent solids. If extrusion hopper coating is to be used, the most useful solids content of the composition is usually between about 20 and 30 weight percent. For doctor blade coating, from about 30 to about 40 weight percent solids is preferred. Wider ranges may be appropriate depending on conditions of use. In preparing heterogeneous compositions for purposes such as ball milling and coating, it may be desirable to use a solvent blend to provide optimal viscosity, ease of solvent removal or the like. Acetonitrile can be useful in combination with methanol to provide a solvent mixture for the cellulose nitrate binders discussed herein.

In applying the photoconductive insulating compositions on a surface or support, they can be coated by any suitable means, such as extrusion hopper, doctor blade or whirler coating apparatus, at a coverage sufficient to provide a layer of from 10 to about 25 microns thick when dry, although wider variations may be useful. In the case of heterogeneous compositions, the dry thickness for any given wet thickness as coated will depend in part on the size of the photoconductive particles in the composition and on the amount of void volume, if any, in the layer. Coverages of from about 2 to about 15 grams per square meter of support are often used.

In electrophotographic elements it may also be desirable to include one or more photoconductive composition layers in addition to the photoconductive layer comprising p-terphenyl as described. In such instances, the several photoconductive layers are normally adjacent one another to form so-called "composite" layers. It is generally recognized in such arrangements that one of the photoconductive layers in the composite serves as a charge-generating layer, while the adjacent photoconductive layer serves as a charge-transport layer. P-quaterphenyl, for example, can be employed in one photoconductive layer adjacent to the p-terphenyl layer of this invention. Preferably, the p-quaterphenyl layer is outermost and closest to the light source. Composite layers such as those comprising respectively p-quaterphenyl and p-terphenyl layers are useful regardless of the polarity of charge imposed on the illuminated surface.

Suitable supporting materials on which can be coated photoconductive layers comprising the photoconductive compositions described herein include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum; electrically conducting metals intermixed with SiO (as described in U.S. Pat. No. 3,880,657 issued Apr. 29, 1975 to A. A. Rasch) and the like, coated on paper or conventional photographic film bases such as cellulose acetate, polystyrene, polyester, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,007,901 by Minsk, issued Nov. 7, 1961 and U.S. Pat. No. 3,262,807 by Sterman et al, issued July 26, 1966. Another useful support is paper or other fibrous material having thereon, to enhance electrical properties of the support, an electrically conducting material as described in U.S. Pat. No. 3,814,599 (issued June 4, 1974 to D. A. Cree), particularly in Columns 2 and 3 of the patent.

Photoconductive compositions according to the present invention can be employed in electrophotographic elements useful in any of the well known electrophotographic processes which require photoconductive layers. One such process is the xerographic process. In a process of this type, an electophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young, issued Mar. 26, 1957; 2,786,440 by Giaimo, issued Mar. 26, 1957; 2,786,441 by Young, issued Mar. 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most wisely used method of obtaining a permanent record is achieved by selecting a developing particle which has as one of its components a low-melting resin. Heating the powder image then causes the resin to melt or fuse into or on the element. The powder is therefore caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review", Volume 15 (1954), pages 469–484.

Because the electrophotographic elements described herein can be developed in a liquid environment, as above described, the non-photoconductive surface of the element, i.e., that side of the support opposite the side carrying the photoconductive layer, can be overcoated with a so-called solvent hold-out layer. One or more of these layers serve to reduce or eliminate penetration of solvent or liquid carriers into the paper support during development. A typical hold-out layer can include pigments, pigment dispersing agents, clays, latices such as styrene-butadiene latex, polyvinylalcohol, and the like, in various proportions to give the desired result.

H and D electrical speeds to indicate the photoconductive response of electrophotographic materials such as those discussed herein can be determined as follows: The material is electrostatically charged under, for example, a corona source until the surface potential, as measured by an electrometer probe, reaches some suitable initial value $V_o$, typically from 100 to about 600 volts. The charged element is then exposed to a 3000° K. Tungsten light source or a 5750° Xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure (in meter-candle-seconds) required to reduce the initial surface potential to any fixed selected value, typically $\frac{1}{2}$ $V_o$ or 100 volts below $V_o$ (100 volt should electrical speed). The foregoing procedure was employed in the examples below. An apparatus useful for determining the electrophotographic speeds of photoconductive compositions is described in Robinson et al, U.S. Pat. No. 3,449,658 issued June 10, 1969.

The following Examples are included to illustrate the present invention:

EXAMPLES 1–13

Solutions of scintillation grade p-terphenyl in each of the solvents listed in Table 1 below were prepared by dissolving the p-terphenyl in the solvent with vigorous magnetic stirring and heating on a hot plate. When dissolution was complete the solutions were heated at reflux for 10 to 15 minutes after which time the heater was turned off. The magnetic stirring was continued as the solution slowly cooled and p-terphenyl crystallized while remaining on the cooling hot plate. After the mixture cooled to room temperature, the crystalline material was collected by vacuum filtration, and air dried for 1 to 2 hours. The crystalline p-terphenyl was then transferred to a crystallizing dish for final air drying over a period of about 24 hours.

To 2.0 portions of the crystallized p-terphenyl materials was added 0.73 g of RS ¼ sec cellulose nitrate (70% solids in 2-propanol) and 6.33 of a solution containing 0.020 g of 4-thiaflavylidylmethylene-flavylium perchlorate and 2.0 g of polyvinyl chlorendate, (51.1 percent chlorine), in methanol.

The above formulations were dispersed by shaking them in screw cap vials for 2 hours on a reciprocating paint mixer with 20 g of 3 mm zirconium oxide milling media. The dispersions were then coated onto nickelized polyester film supports at 0.08 mm wet thickness. Samples of the elements were tested in an electrophotrographic process to yield the relative speed data in Table 1. The control element contained p-terphenyl which was crystallized from toluene during its manufacture. The speed of the control was arbitrarily assigned a value of 100. The electrical speeds indicated were determined in the manner previously described in discharging a positive 300 volt initial surface potential to ½ the initial surface potential (+150 volts).

TABLE I

| Example | Solvent | $\delta_d/\delta_p/\delta_h$ | Amounts: gms. p-Terphenyl/ Solvent ml | Relative Electrical H & D Speed |
|---|---|---|---|---|
| | control | | — | 100 |
| 1 | Acetic Acid | 7.1/3.9/6.6 | 5/250 | 139 |
| 2 | Acetone | 7.6/5.1/3.4 | 10/1000 | 128 |
| 3 | Acetonitrile | 7.5/8.8/3.0 | 5/400 | 99 |
| 4 | Benzene | 9.0/0.0/1.0 | 20/300 | 105 |
| 5 | n-Butyl Acetate | 7.7/1.8/3.1 | 15/300 | 140 |
| 6 | 1,2-Dichloroethane | 9.3/3.6/2.0 | 20/250 | 103 |
| 7 | 1,4-Dioxane | 9.3/0.9/3.6 | 20/250 | 83 |
| 8 | Ethyl Acetate | 7.7/2.6/3.5 | 10/400 | 145 |
| 9 | 2-Propanol | 7.7/3.0/8.0 | 5/1000 | 166 |
| 10 | Pyridine | 9.3/4.3/2.9 | 25/250 | 61 |
| 11 | Tetrahydrofuran | 8.2/2.8/3.9 | 20/300 | 93 |
| 12 | Toluene | 8.8/0.7/1.0 | 20/250 | 96 |
| 13 | Xylene | 8.65/0.5/1.5 | 20/250 | 92 |

EXAMPLES 14–16

Following the procedure of examples 1–13, scintillation grade p-terphenyl was crystallized from the solvents listed in Table 2. The crystallized p-terphenyls were formulated into a heterogeneous photoconductive composition and coated on respective electrically conducting supports to form electrophotographic elements in a manner similar to the preceding examples. With the electrical H & D speed of the element having p-terphenyl crystallized from xylene arbitrarily assigned as 100, the relative electrical H & D speeds to discharge +300 volt $V_o$ to +150 volts of the other elements were as shown in Table 2.

TABLE 2

| Example | Solvent | $\delta_d/\delta_p/\delta_h$ | Relative Electrical H & D Speed |
|---|---|---|---|
| 14 | xylenes (control) | 8.7/0.5/1.5 | 100 |
| 15 | acetic acid | 7.1/3.9/6.6 | 146 |
| 16 | acetic acid/xylene (25/75 by volume) | 8.3/1.4/2.8 | 153 |

EXAMPLE 17

5 gram portions of various batches of p-terphenyl were crystallized from 250 ml portions of glacial acetic acid in a manner similar to that in the preceding examples.

To 2.0 g portions of the acetic acid crystallized p-terphenyl and to untreated control samples of p-terphenyl crystallized from toluene was added 0.5 g of a methyl methacrylate/methacrylic acid copolymer (75/25) and 6.56 g of a solution containing 0.060 g of 4-triaflavylidylmethylene flavylium perchlorate and 0.61 g of poly(vinylchlorendate) in 160 g of methanol and 40 g of acetonitrile.

The above formulations were dispersed, coated and evaluated electrophotographically as in the preceding examples. Elements comprising the acetic acid crystallized p-terphenyl exhibited from 12 to 288 percent higher electrical speed relative to their respective controls (the wide variation in electrical speed improvement effected by the treatment are believed to stem from impurities present in the starting materials).

EXAMPLES 18–19

To further evaluate the effect of crystallization, 10 grams of scintillation grade p-terphenyl was slurried with, as opposed to being dissolved in, 450 ml of glacial acetic acid at room temperature, thereafter recovered and dried as in the preceding examples, and formulated into an electrophotographic element following the procedure of examples 1–13. The resulting element was evaluated in an electrophotographic process and compared with both the control element and the element in which the p-terphenyl had been crystallized from glacial acetic acid, as described in examples 1–13. Results obtained are reported in Table 3.

TABLE 3

| Example | Treatment of p-terphenyl | Relative Electrical H & D Speed |
|---|---|---|
| | None (control) | 100 |
| 18 | Slurry with acetic acid | 102 |
| 19 | Crystallization from acetic acid | 136 |

EXAMPLES 20–22

Scintillation grade p-terphenyl was crystallized from glacial acetic acid. To assess the reversability of the high speed observed for materials crystallized from one of the preferred solvents, in this case glacial acetic acid, 10 gram portions of the crystallized high speed material were dissolved in, respectively, 475 ml of glacial acetic acid and 125 ml of xylene. The solutions were stirred and simultaneously heated at reflux for approximately 10 minutes on a hot plate. After the heat source was turned off, the solutions were permitted to cool on the hot plate, while stirring was continued.

The resulting crystalline materials were collected by vacuum filtration after cooling to room temperature. The collected crystals were air dried for approximately 2 hours before transfer to crystallizing dishes for final air drying.

The crystals were milled, dispersed, coated and evaluated as in Example 17. The electrical speeds of the resulting elements were determined relative to an otherwise identical control comprising the original scintillation grade p-terphenyl. Results are shown in Table 4.

TABLE 4

| Example | Treatment of p-terphenyl | Relative Electrical H & D Speed |
|---|---|---|
| | None (control) | 100 |
| 20 | 1st crystallization from acetic acid | 151 |
| 21 | 2nd crystallization from acetic acid | 159 |
| 22 | crystallization from xylene of the p-terphenyl first crystallized from acetic acid (example 20) | 115 |

The invention has been described with particular reference to certain preferred embodiments thereof but it will be understood that variations and modifications can be effected within the spirit and scope of the invention.

What is claimed is:

1. A method of producing a p-terphenyl photoconductor having high electrophotographic speed, which method comprises (a) forming a solution of p-terphenyl in a solvent having solubility parameters in about the following ranges:

$\delta_d$: 7.1–8.3

$\delta_p$: 1.4–5.1

$\delta_h$: 2.8–8 and (b) crystallizing said p-terphenyl from said solution.

2. The method according to claim 1 wherein said solubility parameters are in about the following ranges:

$\delta_d$: 7.1–7.7

$\delta_p$: 1.8–5.1

$\delta_h$: 3.1–8

3. The method according to claim 2 wherein said solvent comprises acetone, acetic acid, ethyl acetate, butyl acetate or 2-propanol.

4. A method of producing a p-terphenyl photoconductor having high electrophotographic speed, which method comprises (a) forming a solution of p-terphenyl in acetone, acetic acid, ethyl acetate, butyl acetate or 2-propanol as a sole solvent, and (b) crystallizing said p-terphenyl from said solution.

5. A method of producing a p-terphenyl photoconductor having high electrophotographic speed, which method comprises forming a mixture of p-terphenyl with acetic acid, heating said mixture to form a solution, and thereafter crystallizing said p-terphenyl therefrom by cooling said solution.

6. A method of producing a p-terphenyl photoconductor having high electrophotographic speed, which method comprises (a) forming a solution of p-terphenyl in a solvent comprising at least two liquid components, said solvent having solubility parameters in about the following ranges:

$\delta_d$: 7.1–8.3

$\delta_p$: 1.4–5.1

$\delta_h$: 2.8–8 and (b) crystallizing said p-terphenyl from said solution.

7. A method according to claim 6 wherein at least one of said liquid components has one or more of said $\delta_d$, $\delta_p$, and $\delta_h$ solubility parameters outside the ranges indicated.

8. A method according to claim 6 wherein said liquid components are xylene and acetic acid in a volume ratio of 75 to 25 respectively.

9. A heterogeneous photoconductive insulating composition comprising particles of a p-terphenyl photoconductor having high electrophotographic speed dispersed in an electrically insulating binder, said photoconductor being produced by (a) forming a solution of p-terphenyl in a solvent having solubility parameters in about the following ranges:

$\delta_d$: 7.1–8.3

$\delta_p$: 1.4–5.1

$\delta_h$: 2.8–8 and (b) crystallizing said p-terphenyl from said solution.

10. The composition of claim 9 wherein said solvent comprises acetone, acetic acid, ethyl acetate, butyl acetate, or 2-propanol, and wherein said p-terphenyl photoconductor is chemically sensitized with polyvinylchlorendate.

11. An electrophotographic element comprising an electrically conducting support bearing thereon a layer of a photoconductive insulating composition comprising particles of a p-terphenyl photoconductor having high electrophotographic speed dispersed in an electrically insulating binder, said photoconductor being produced by the method of claim 1.

12. The electrophotographic element of claim 11 comprising an electrically conducting paper support, wherein said composition additionally comprises a matte agent, polyvinylchlorendate chemical sensitizer, and at least one of a cyanine and benzothiapyrylium spectral sensitizer.

13. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 11.

14. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 12.

15. An electrophotographic copy comprising an element as described in claim 12 and a visible image pattern electrophotographically formed and developed on said photoconductive insulating layer.

* * * * *

UNITED STATES PATENT AND TRADEMARK OFFICE

CERTIFICATE OF CORRECTION

PATENT NO. : 4,250,237

DATED : February 10, 1981

INVENTOR(S) : Richard S. Vickers

It is certified that error appears in the above-identified patent and that said Letters Patent are hereby corrected as shown below:

Column 4, line 45, replace $$"\delta_p^{\ 2} = \frac{12,108}{V^2} \quad \frac{\varepsilon - 1}{2\varepsilon - \eta_D^2} \cdot (\eta_D^2 + 2)\nu^2 \text{ "} \quad \text{with}$$

$$--\delta_p^{\ 2} = \frac{12,108}{V^2} \cdot \frac{\varepsilon - 1}{2\varepsilon - \eta_D^2} \cdot (\eta_D^2 + 2)\nu^2 \text{ --.}$$

Column 5, line 23, change "solute" to -- soluble --;

line 26, "$\delta$=9.3" should read -- $\delta_d$=9.3 --.

Column 7, line 4, change the spelling of "hexachlorocyclopentane" to -- hexachlorocyclopentene --.

Column 8, line 27, "poly alkylacrylic" should read -- polyalkylacrylic --.

Column 14, line 7, "4-tria-" should read -- 4-thia- --.

Signed and Sealed this

***Fifth* Day of *May 1981***

[SEAL]

*Attest:*

RENE D. TEGTMEYER

*Attesting Officer* *Acting Commissioner of Patents and Trademarks*